United States Patent [19]

Schmelzer

[11] Patent Number: 5,010,965

[45] Date of Patent: Apr. 30, 1991

[54] SELF-PROPELLED RAM BORING MACHINE

[75] Inventor: Robert Schmelzer, Lennestadt, Fed. Rep. of Germany

[73] Assignee: Tracto-Technik Paul Schmidt Maschinenfabrik KG

[21] Appl. No.: 505,047

[22] Filed: Apr. 4, 1990

[30] Foreign Application Priority Data

Apr. 8, 1989 [DE] Fed. Rep. of Germany ..... 3911467

[51] Int. Cl.[5] ..... E21B 4/06; E21B 7/08; E21B 47/024

[52] U.S. Cl. ..... 175/19; 175/45; 175/61; 175/306; 175/62

[58] Field of Search ..... 175/19, 45, 61, 305, 175/306, 62; 173/20

[56] References Cited

U.S. PATENT DOCUMENTS

| | | | |
|---|---|---|---|
| 3,525,405 | 8/1970 | Coyne et al. | 175/19 |
| 3,712,387 | 1/1973 | Vincent et al. | 175/296 X |
| 4,621,698 | 11/1986 | Pittard et al. | 175/19 X |
| 4,694,913 | 9/1987 | McDonald et al. | 175/61 |
| 4,867,255 | 9/1989 | Baker et al. | 175/296 |
| 4,907,658 | 3/1990 | Stangl et al. | 175/19 |

FOREIGN PATENT DOCUMENTS

| | | |
|---|---|---|
| 2340751 | 2/1974 | Fed. Rep. of Germany . |
| 3306070 | 8/1984 | Fed. Rep. of Germany . |
| 2634066 | 2/1978 | Fed. Rep. of Germany . |
| 2187224 | 9/1987 | United Kingdom . |
| 0322170 | 6/1989 | European Pat. Off. . |
| 2157259 | 11/1972 | Fed. Rep. of Germany . |
| 3027990 | 3/1982 | Fed. Rep. of Germany . |
| 1807351 | 7/1969 | Fed. Rep. of Germany . |
| 0323433 | 7/1989 | European Pat. Off. . |

*Primary Examiner*—Stephen J. Novosad
*Attorney, Agent, or Firm*—Toren, McGeady & Associates

[57] ABSTRACT

In a self-propelled ram boring machine, in particular for making earth bores, having a striking tool at the leading end of a cylindrical housing, a striking piston movable to subject said striking tool to ramming blows, said striking piston being driven with pulsating, translatory working strokes, the striking tool is mounted in the housing to rotate about the axis of rotation and comprises kinematic means cooperating with the housing to change a translatory movement following each blow of said striking piston into a gradual rotary movement, and pneumatically operable means for initiating or interrupting the rotary movement.

16 Claims, 4 Drawing Sheets

SELF-PROPELLED RAM BORING MACHINE

TECHNICAL FIELD OF THE INVENTION

The invention relates to a self-propelled ram boring machine, in particular for making earth bores, having an impact tool arranged on the leading end of a cylindrical housing and subjected to ramming blows from a striking piston, the striking piston being pneumatically operable in translatory working strokes.

BACKGROUND OF THE INVENTION AND PRIOR ART

A pneumatically operated ram boring machine having a striking tip held in a cylindrical housing and a striking piston reciprocating in the housing is known from German patent specification No. 21 57 259. The automatic piston of this machine applies periodic ramming blows to the movable striking tip. The striking tip is supported on the housing through a compression spring and moves into the ground in an oscillating manner under the influence of these ramming blows and finally pulls the housing after it when its stroke is complete.

On the other hand a ram boring machine is known from German Offenlegungsschrift No. 21 05 229 in which the striking tip is a fixed component of the machine housing.

Ram boring machines of this kind are a preferred means of laying service lines such as those for water supply and drainage, for electric power or for telephone connections underground without the need to dig trenches. The ram boring machine moves in the ground, forcing aside and compacting the earth as it drives forwards and forming a tunnel into which a service line or cable can be inserted without difficulty.

The design of the ram boring machines according to the prior art is such that only substantially straight bores or earth tunnels can be made, i.e. the working direction cannot be changed once it has been set. Machines of this kind are also described for example in German patent specifications Nos. 23 40 751 and 26 34 066.

However, in practice it has been found that uncontrollable directional deviations can occur, especially in non-homogenous ground and in particular when covering long distances. As a result there is an urgent technical need for a ram boring machine whose working direction can be controlled and steered. Steerability is also necessary, for example, to enable the machine to avoid particularly large obstacles or other service lines crossing its path.

A self-propelled ram boring machine, in particular for making earth bores, having an impact head acted on by a striking piston reciprocating in the machine housing and having guiding surfaces for controlling the course of the machine is known from German patent specification No. 30 27 990. A characteristic of this machine is that the striking tip has an oblique front face. Interchangeable oblique front faces having different oblique angles may, for example, be provided. The oblique face can also be roof-shaped.

The advantage of this kind of machine is that the oblique face gives the ram boring machine a component of movement in the ground perpendicular to its axis, which results in the earth bore made by the ram boring machine following a curved course. The radius of the curve depends on the oblique angle of the oblique face, so that different radii can advantageously be obtained by the use of interchangeable striking tips with oblique faces having different oblique angles. Another possibility is to use an adjustable oblique face on the striking tip. The alternative roof shape increases the driving capacity of the machine.

Even with this known machine the predetermined curved course cannot be changed or influenced as desired during uninterrupted forward movement and thus the machine cannot be deliberately steered.

OBJECT OF THE INVENTION

It is an object of the invention to provide a ram boring machine of the kind referred to in the introduction which overcomes the present technical limitations and makes it possible to rotate the machine tip or a striking tool arranged at the front of the housing while driving forwards in order, for example, to influence and monitor the direction of movement as desired during uninterrupted operation and thereby control the direction of movement by a deliberate steering intervention.

SUMMARY OF THE INVENTION

To this end, in a self-propelled ram boring machine of the kind referred to in the introduction, according to the invention the striking tool, which can also be the tip of the machine, is mounted in the housing to rotate about the axis of rotation and is provided with kinematic means cooperating therewith to change a translatory movement following each blow of the striking piston into a gradual rotary movement, and with means, preferably pneumatically controllable, to initiate or interrupt the rotary movement.

The striking tool or the tip of the machine can be provided with an oblique face to enable the direction of movement (direction of advance) of the machine to be influenced.

An advantage of the self-propelled ram boring machine according to the invention is that it is possible to control and influence its direction of movement from outside during continuous forwards operation and thereby control the working direction of the machine underground by deliberate steering intervention. This is achieved in a simple manner as follows: in operating with continuous rotary movement of the striking tool, and with the head of the ram boring machine rotating about the longitudinal axis of the machine in time with the striking rate of the striking piston, movement forwards in a straight line occurs with hardly any directional deviations. To effect a controlled directional deviation the rotation of the longitudinally moving impact head is interrupted, resulting in a curved section of the earth bore corresponding to the oblique setting of the oblique front guiding face.

The plane of this curved forward movement extends approximately perpendicular to the oblique guiding or steering face of the striking tool. It is therefore necessary to be able to determine and adjust the angular position of this oblique guiding face relative to a reference plane, for example the horizontal plane.

For this purpose, in an embodiment of the invention, the striking tool is associated with at least one sensor signalling its rotary angular position relative to an imaginary reference plane fixed relative to the housing and intersecting the longitudinal axis of the housing. This sensor is preferably arranged in the front part of the housing. It is known that the directional stability of a self-propelled ram boring machine can be improved if the machine is provided with a sensor arranged as far forward as possible in the direction of advance.

In an embodiment of the machine the striking tool is essentially a cylindrical striking mandrel having a front shaft part merging into a striking tip and carrying the impact head with the oblique surface, a rear shaft part having a striking face, and between them a section of larger diameter in the form of a piston with an annular piston surface.

In this case one shaft part of the striking tool has a sleeve-shaped screw with coarse-pitch threads, arranged to be non-displaceable in the direction of the axis of rotation but rotatable on the shaft part, which engages with an annular nut that is anchored in the housing and has a complementary coarse thread, there being a free-wheel between the shaft part and the screw.

As a result of this kinematic engagement of the thread profiles of the screw and nut, every time the piston strikes the surface of the striking tip and the striking tool moves translatorily forwards to the stop by the length of its working stroke, the screw and nut perform a helical movement relative to one another in both the translatory and the rotary directions. The free-wheel ensures that the striking tip only rotates in a predetermined direction and only with either the forward stroke or the return stroke.

The arrangement is preferably such that the striking tip only rotates with the return stroke of the striking mandrel. This results in an extremely gentle manner of operation. The system could also be designed so that the striking mandrel would move in a translatory/rotary manner with the forward stroke and only in a translatory manner with the return stroke. This would, however, lead to a comparatively extremely jerky, and therefore high, mechanical stress on the free-wheels and the flanks of the screw and nut threads, which would subsequently prejudice trouble-free operation. With this in mind, in a preferred embodiment of the invention the striking tip with the oblique-faced impact head rotates through a certain angle about the axis of the housing with each return stroke of the striking tool according to a setting of the freewheel.

The faster the striking piston strikes per unit of time the more often will the entire impact head rotate per unit of time. The angle of rotation per stroke depends on the pitch of the profile of the profiled screw and profiled nut and the length of the stroke of the striking tool.

In an embodiment of the pneumatically controllable means for initiating or interrupting the rotary movement, the piston between the two shaft parts and a cylindrical sleeve arranged in the housing are formed and arranged as a cooperating piston/cylinder unit. The working chamber of the piston/cylinder unit can also be connected to a compressed air source via bores extending parallel to the axis in the wall of the housing and formed as pressure passages.

By means of these control elements interruption of the rotation can be initiated by depressurizing the working chamber of the piston/cylinder unit, whereupon the striking mandrel is held in the forward position so that when the striking piston strikes, there is no translatory movement and accordingly no rotary movement.

For absolute measurement of the setting of the oblique face to the horizontal it is necessary to determine the direction of rotation of the ram boring machine about the longitudinal axis and the rotary setting of the impact head relative to the ram boring machine. For this purpose, according to a further proposal, the machine is provided with an inclinometer, for example a wire that is stiff in torsion, mounted non-rotatably on the housing, to determine the angular position of its housing, measured by the inclination of the imaginary longitudinal sectional plane, fixed relative to the housing, to a reference plane in space, for example the horizontal plane. The wire can also be subsequently pulled in by the machine when the earth bore is curved, and because of its torsion-stiffness can detect the rotation of the ram boring machine about the longitudinal axis even in relatively long and curved bores.

The machine can also be used with great advantage as a control device in a boring installation, particularly a horizontal one, in which it is arranged at the front of and connected non-rotatably to a boring rod.

Furthermore, to increase its working and boring capacity the machine can be connected in a positive manner via a boring rod to a feeding device that pushes this forward from behind. Finally, in a particularly simple embodiment, the feeding device can be designed to cooperate with a rotary rod drive.

BRIEF DESCRIPTION OF THE DRAWINGS

Preferred embodiments of the invention are shown diagrammatically in the drawings, wherein further advantageous details of the invention can be seen. In the drawings.

DETAILED DESCRIPTION OF PREFERRED EMBODIMENTS OF THE INVENTION

Figure 1:
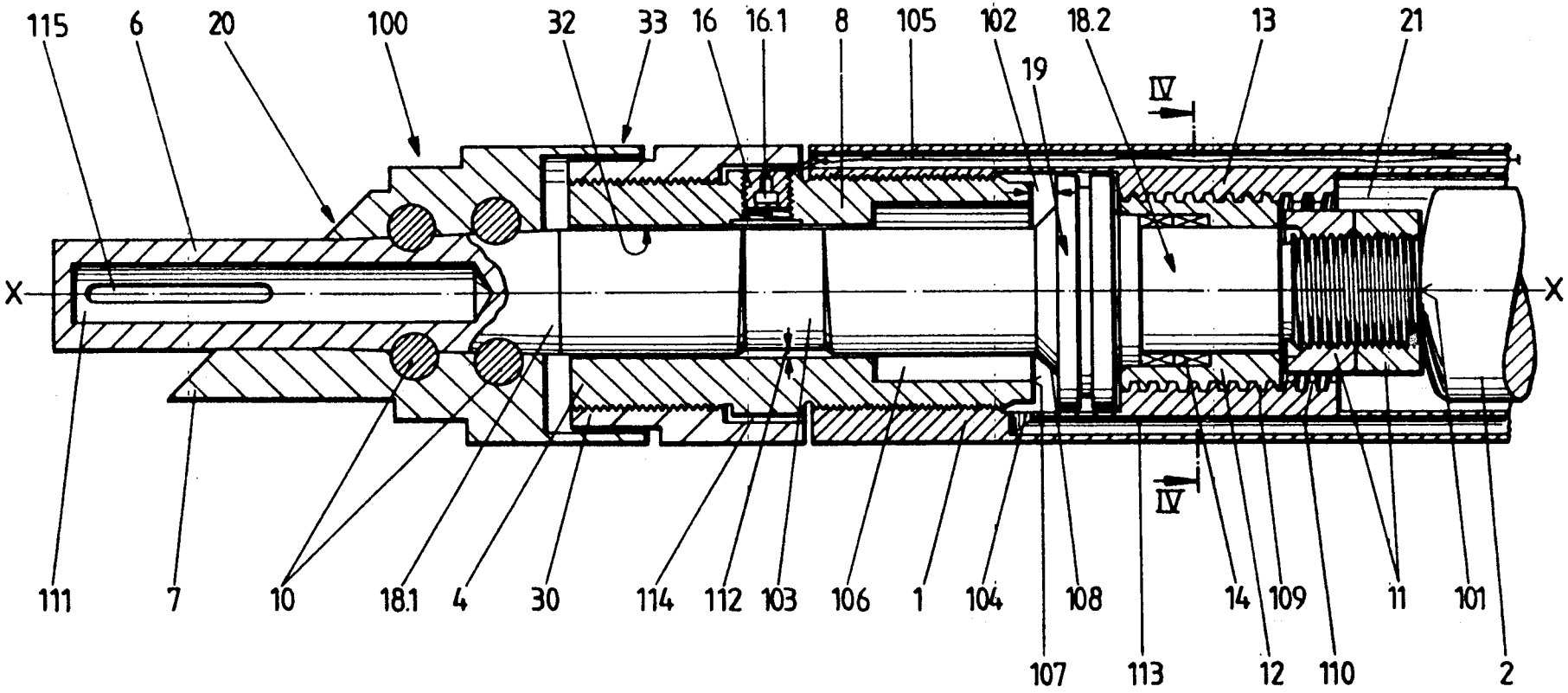
FIG. 1 shows a longitudinal section of the machine.

The ram boring machine shown in FIG. 1 has on the leading end of its cylindrical housing 1 an axial striking tool 100 with an oblique front guiding face 20 arranged to move through the stroke length 102 and which can be subjected to ramming blows from a striking piston 2. The striking piston 2 is constructed and arranged to be operated pneumatically by means of compressed air in pulsating, translatory strokes.

The striking tool 100 with its oblique face 20 is mounted in the housing to rotate about the axis of rotation x—x and has kinematic means 12, 13, 14 that cooperate with the housing to change a translatory movement following each blow of the striking piston 2 into a gradual rotary movement, and pneumatically controllable means 8, 19, 105, 106 to initiate the rotary movement or to interrupt it.

The striking tool 100 comprises essentially a cylindrical striking mandrel having a front shaft part 18.1 merging into a striking tip 6 and supporting the impact head 7 with the oblique face 20, and a rear shaft part 18.2 having a striking face 101, and in between them a section of larger diameter in the form of a piston 19 having an annular piston surface 108. The shaft part 18.1 and the impact head 7 are securely fixed together by dowel pins 10.

The striking tool 100 has associated with it at least one sensor 16 that signals its rotary angular position relative to an imaginary reference plane y—y (FIG. 4) fixed relative to the housing and intersecting the longitudinal axis x—x of the housing, and, according to the exemplary embodiment, is preferably arranged in the front part of the housing 1. This sensor 16 can preferably comprise an inductive transmitter having at least two induction coils 16.1, 16.2 arranged on the periphery of, but not in contact with, the shaft part 18.1 and spaced uniformly around the housing 1, and having an eccentric section 103 of the shaft part 18.1 cooperating therewith.

The way in which the measuring unit illustrated here operates inductively is that when the striking tool 100 rotates, because the shaft part 18.1 is formed with an eccentric part 103 in the region of the sensor coils 16, the distance 112 of the ferromagnetic mass of this eccentric section 103 changes depending on the rotational position relative to the coils 16 or their magnetic core 16.1 according to the angular position of the striking mandrel and gives a corresponding inductive signal. The coil leads then extend parallel to the axis through the jacket bore 105 (FIG. 4) to the rear end of the machine and further through the earth bore to the control station.

Furthermore, to control and locate the ram boring machine in the ground a comprehensive measuring system is required. For example the vertical position of the ram boring machine, measured from the surface of the ground, and the lateral position must be determined. In addition, it must be possible to determine the position of the oblique face relative to the horizontal.

To measure the vertical and lateral position of the ram boring machine a bore 111 to receive a directional transmitter is provided in the tip 6 of the striking tool 100. This transmitter (not shown) transmits signals that emerge through longitudinal slits 115 provided in the striking tip 6. Because of these outlet slits 115 the intensity of the transmitted pulses changes according to the angle of these slits to the horizontal and thus makes it possible to determine the setting of the oblique face 20 relative to the horizontal, as is shown purely diagrammatically in FIG. 2. The transmitted pulses are indicated by the numeral 116.

As already mentioned, detection of the rotational position of the oblique face 20 to the horizontal can be done by measuring the rotation of the ram boring machine about the longitudinal axis x—x and the rotational position of the impact head relative to the housing 1. The two measured values then give the absolute setting of the oblique face 20 to the horizontal. To measure the rotation of the ram boring machine about its longitudinal axis x—x an inclinometer 27 can be attached thereto, as shown diagrammatically in FIG. 2, which sits at the end of the ram boring machine or else slightly behind the ram boring machine and connected to the ram boring machine by means of a non-rotatable coupling, for example with the coupling elements 24, 25. The current supply leads and the leads for monitoring the measured values extend from the induction coils 16 through the annular passage 114 and the bore 105 to the end of the machine and further to the current source or to the data acquisition device.

A method already mentioned for measuring the setting of the oblique face 20 and thereby possibly also monitoring the afore-mentioned measurement consists in evaluating the transmitted pulses 116 of the directional transmitter installed in the tip 6 of the striking tool 100.

The transmitter/receiver system is designed so that the transmitter pulses give a signal X when the oblique face 20 faces upwards and a signal X2 when it faces downwards; when the oblique face is facing the left side a signal X3 is given, and when facing the right side a signal X4 is given.

On this basis four settings of the oblique face 20 are indicated on the full circle of 360°. Any desired intermediate setting of the oblique face on the full circle of 360° can be indicated by means of corresponding electronic evaluation. In this way, by appropriate deliberate positioning of the oblique guiding face 20 the ram boring machine can be controlled to deviate from a straight line by means of simple steering intervention to the right, left, upwards or downwards.

The measuring device described and the measuring method based thereon are only to be viewed as an example within the scope of the invention. They are of particular advantage because of their simplicity. This does not, however, exclude the use of other devices and methods of measuring the setting of the oblique guiding face 20 on the striking tool 100. For example the setting of the oblique face 20 can also be determined by attaching two potentiometers non-rotatably to the compressed air hose 118 close behind the machine or on the end of the machine. One of these potentiometers measures the perpendicular line (rotational setting of the ram boring machine 1), while the other potentiometer indicates the rotational or head setting of the striking tool 100, for example by means of a flexible shaft which extends axially and centrally through the ram boring machine to the striking tip 6 and is connected therewith so as not to rotate.

So that only the striking tool 100 and not the housing itself or the ram boring machine rotate in the earth it may be necessary to provide the ram boring machine with stabilising surfaces 17 which serve to prevent rotation.

With regard to the mechanical design of the machine according to the invention, FIG. 1 shows in addition the form of the piston 19 between the front shaft part 18.1 and the rear shaft part 18.2 of the striking mandrel. On its rear end it has the striking face 101 which is subjected to pulsating blows of the striking piston 2. Between the rear piston surface and two locked nuts 11, there is a sleeve-like screw 12, non-displaceable in the direction of the axis of rotation x—x on the shaft part 18.1 but rotatable. This screw 12 has a coarse-pitch thread 109 engaging with an annular nut 13 having a complementary coarse-pitch thread 110 anchored in the housing 1. The free wheel 14 is arranged between the shaft part 18.2 and the screw 12. The free wheel, as already mentioned, is designed so that with the forward movement of the striking mandrel under the influence of a ramming blow from the striking piston 2 the screw 12 freewheels relative to the shaft part 18.2, but with the return stroke of the striking tool a rotary movement is effected. This return stroke occurs as a result of the design of the piston 19 and the sleeve 8, which is securely screwed into the housing 1, and by the effect of compressed air in the chamber 106 surrounded by the sleeve 8, forming the piston/cylinder unit, when the annular face 108 of the piston 19 is pressurized with compressed air. This compressed air is introduced through the bore 113 and its connection opening 104 into the pressure chamber 106.

The prevention of the striking tool 100 from rotating results from the depressurization of the pressure chamber 106, whereby the piston 19 and thus the striking tool 100 are held in the forward position, with the front face of the piston 19 adjoining the stop edge 107 of the screw coupling 8. The striking tool is held in this position by air pressure in the chamber 21 during the return stroke of the striking piston 2 for as long as the pressure chamber 106 remains depressurized.

The screw coupling 8 is surrounded by the cap 30 screwed thereon which protects the incorporated sensor coils 16.1, 16.2 from contamination and the penetration of moisture. On delivery of compressed air through the bore 113 and the opening 104 into the pressure chamber 106 bleeding of compressed air occurs with relaxation along the sealing gap between the shaft part 18.1 and the front screw coupling 8, depending on the clearance gap 32 resulting from the clearance between these two components. This exhaust air issuing in the bleeding serves on the one hand as a guiding, sliding, and lubricating agent for the striking mandrel and its shaft part 18.2 because of the oil mist it carries with it. Furthermore this air escapes into the open between the striking tool 100 and its cylindrical collar 33 that embraces the front screw coupling 30 and in flowing out prevents moisture or contaminants from entering the protective gap between these latter components.

Figure 2:
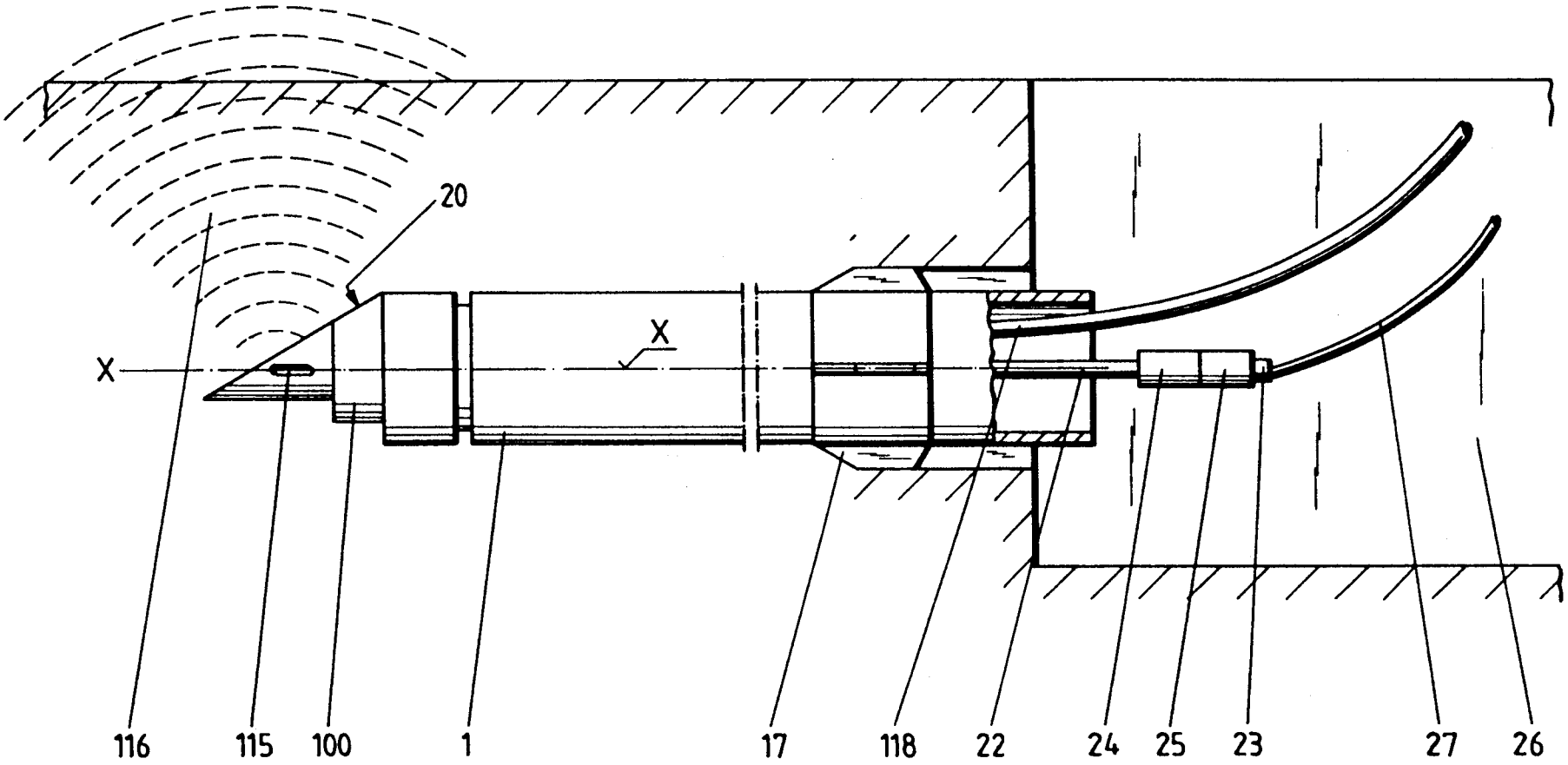
FIG. 2 shows a side elevation of the machine.

FIG. 2 shows in side elevation, purely diagrammatically, the machine penetrating the ground from a starting trench 26. It carries on its rear end the guiding or stabilising surfaces 17 which prevent the housing 1 from rotating about its axis x—x when the striking tool 100 and its oblique guiding face 20 rotate in the opposite direction during the advancing operation. At the rear end the compressed air hose 118 can be seen. In addition the machine is fitted with a flexible but torsionally stiff inclinometer 27 via the coupling elements 24, 25 and the fastening member 23. The transmitter incorporated in the head of the striking tool 100 transmits, preferably through the slits 115, locating signals 116 which are received and evaluated above ground in a manner known per se. In this way, as already mentioned, the depth, running direction and setting of the oblique face 20 to the horizontal can be determined. The rotational setting of the housing 1 is transmitted by way of the inclinometer 27 to a mechanical, electrical or electronic receiver and gives a further measuring signal which, for example in association with a rotational setting signal from the sensor coils 16, 16.1, give an exact rotational location of the oblique guiding face 20.

In this way it is possible to start either from the one measuring signal or from the last two measuring signals. However, all the measuring signals can be evaluated together to a form very precise locating system.

Figure 3:
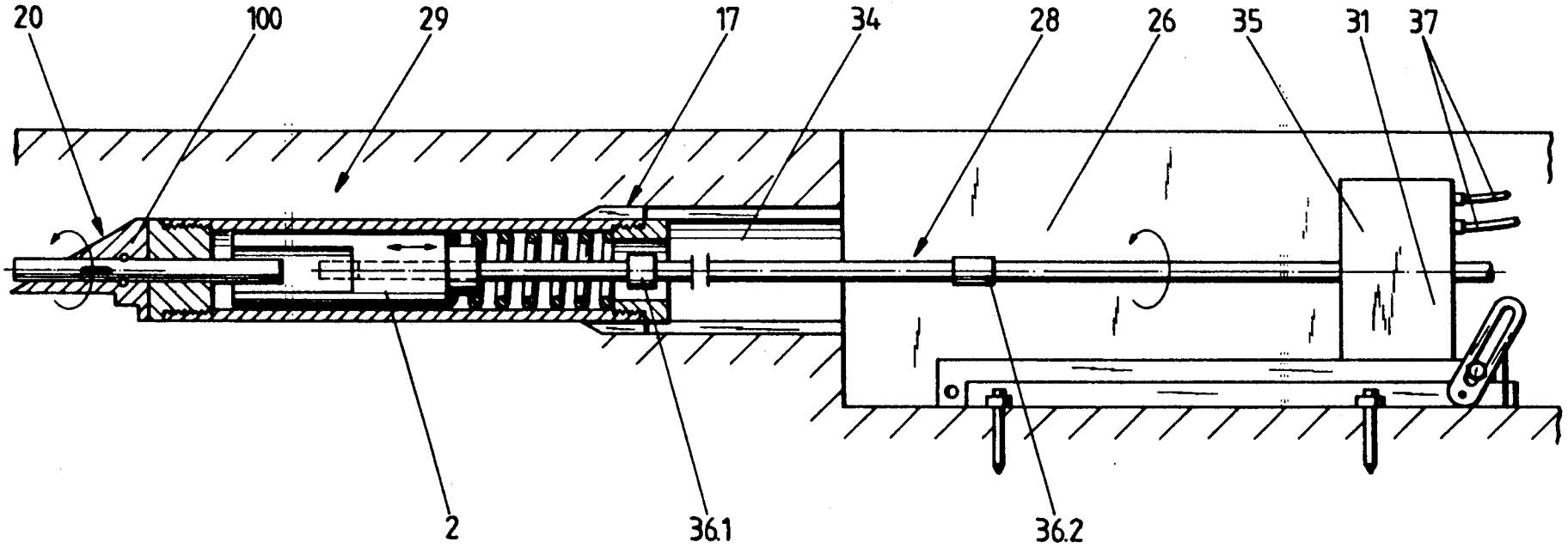
FIG. 3 shows a horizontal boring installation comprising a boring rod with a ram boring machine arranged at the front having a rotatable striking tool with an oblique front face.

Shown purely diagrammatically in FIG. 3 is a horizontal boring installation emerging from the starting trench 26. It has a boring rod 28, and arranged at the front of this boring rod 28 is a ram boring machine which is arranged to function as both a driving and a control device 29. The control function arises because the machine can be operated either with a continuously rotating striking tool 100 or can make a directional correction after a steering intervention by setting the position of the oblique guiding face 20 to a particular angle to the horizontal and/or to the vertical while the striking tool 100 is temporarily held non-rotatable.

To improve the driving and boring capacity of the machine it can be connected positively by way of the boring rod 28 to a feeding device 31 that pushes it forward from behind. In a suitable embodiment this feeding device 31 can, as is common in boring installations, impart both translatory and rotary kinetic energy to the boring rod 28. For this purpose the feeding device 31 has, for example, an additional hydraulic rotary drive 35 with high-pressure oil lines 37. The tunnel made in the ground by the horizontal boring plant is indicated by the numeral 34. This machine is also equipped with guiding surfaces 17 which increase directional stability and simultaneously improve steerability.

The ram boring machine shown in FIG. 3 can be designed so that the striking piston 2 can be excited into oscillating stroke movements independently of the boring rod 28 pushing behind by means of a pneumatic drive supplied with compressed air. The boring rod 28 is made up of sections connected to form a complete rod by couplings 36.1, 36.2.

Figure 4:
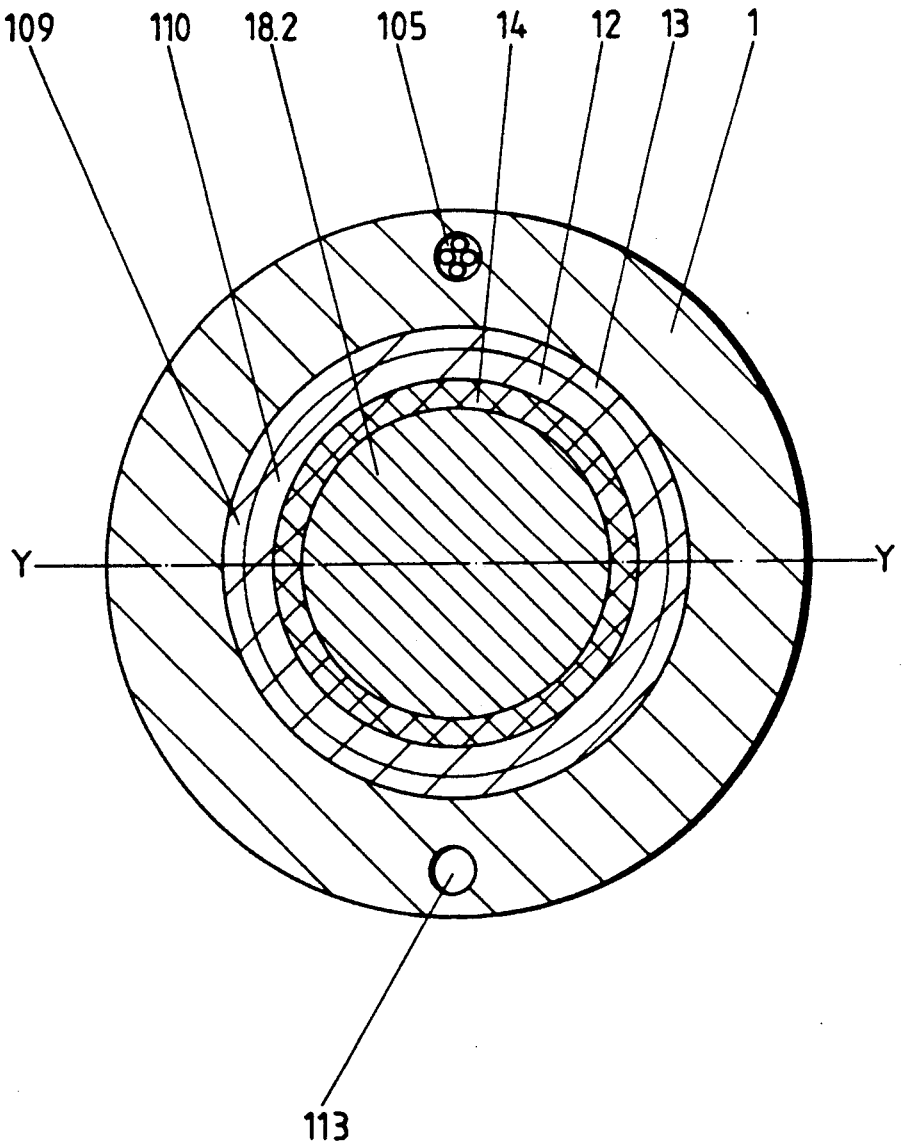
FIG. 4 a cross-section through the machine along the sectional plane IV—IV in FIG. 1.

FIG. 4 shows a section through the machine shown in FIG. 1 along the plane IV—IV. Corresponding parts of the machine are indicated by the same reference numerals as in FIG. 1. Two bore passages 113 for compressed air and 105 for measuring leads are provided in the comparatively thick-walled housing 1. The sectional representation shows in the core the shaft part 18.2 with the sleeve-shaped screw 12 rotatable about it but not axially displaceable, and having a helical screw profile 110, and the likewise sleeve-shaped nut 13 anchored in the housing 1 having a complementary profile 109. The free wheel 14 is incorporated between the screw 12 and the shaft part 18.2. A reference plane for determining a rotational setting of the housing 1 relative to a plane in space for example the horizontal plane, is indicated by y—y.

The rotary drive according to the invention is not only suitable for steerable ram boring machines, but can in addition be used with all machines having a housing part or tool, for example with a rotatable striking tip, that can rotate about the longitudinal axis.

What is claimed is:

1. A self-propelled ram boring machine, in particular for making earth bores, having a striking tool at the leading end of a cylindrical housing, a striking piston movable to subject said striking tool to ramming blows, said striking piston being driven with pulsating, translatory working strokes, wherein said striking tool is mounted in the housing to rotate about the axis of rotation and comprises kinematic means cooperating with said housing for transforming a translatory movement following each blow of said striking piston into a gradual rotary movement, and means for initiating or interrupting the rotary movement.

2. A machine according to claim 1, wherein said striking tool is provided with an oblique face.

3. A machine according to claim 1, wherein associated with said striking tool is at least one sensor signalling its rotational angular position relative to an imaginary reference plane (y—y) fixed relative to the housing and intersecting the longitudinal axis (x—x) of said housing.

4. A machine according to claim 3, wherein said sensor is arranged in the front part of said housing.

5. A machine according to claim 1, wherein said striking tool comprises essentially a cylindrical striking mandrel having a front shaft part merging into a striking tip and carrying the impact head with the oblique face, a rear shaft part having a striking face, and a section of larger diameter in between them in the form of a piston having an annular piston surface.

6. A machine according to claim 5, wherein said rear shaft part of said striking tool has a sleeve-shaped screw with a coarse-pitch movement thread, said screw being rotatable on said shaft part but non-displaceable in the direction of the axis of rotation (x—x) and engaging with an annular nut having a complementary coarse-pitch thread anchored in said housing, and wherein a free-wheel is arranged between said rear shaft part and said screw.

7. A machine according to claim 5, wherein said piston having an annular piston surface and a cylindrical sleeve arranged in said housing are designed and arranged as a cooperating piston/cylinder unit.

8. A machine according to claim 7, wherein the working chamber of said piston/cylinder unit can be connected to a compressed air source by way of bores, formed as compressed air passages, extending parallel to the axis in the wall of the housing.

9. A machine according to claim 5, comprising a sensor for determining the angular setting of said striking tool relative to an imaginary longitudinal section plane of the housing (y—y) fixed relative to the housing, said sensor comprising an inductive transmitter with at least two induction coils arranged on the periphery of but not in contact with said front shaft part and spaced uniformly around the housing, and an eccentric section of said front shaft part cooperating with said coils.

10. A machine according to claim 5, wherein said front shaft part has in the region of its tip a bore for accommodating a directional transmitter.

11. A machine according to claim 1, wherein said machine has an inclinometer, for example a torsionally stiff wire, mounted non-rotatably on the housing to determine an angular setting of the housing, relative to the inclination of an imaginary longitudinal sectional plane (y—y) fixed relative to the housing, to a reference plane in space, for example the horizontal plane (x—x).

12. A machine according to claim 1, said machine forming part of a horizontal boring installation and being arranged at the leading end of and connected non-rotatably to a boring rod to serve as a control device.

13. A machine according to claim 1, wherein to increase its driving and boring capacity said machine is connected positively by way of a boring rod to a feeding device pushing it forward from behind.

14. A machine according to claim 13, wherein said feeding device is arranged to cooperate with a rotary rod drive.

15. A machine according to claim 1, wherein said striking tool is mounted to be axially movable in said housing.

16. A machine according to claim 1, wherein said means for initiating or interrupting the rotary movement of said striking tool is pneumatically controllable.

* * * * *